United States Patent [19]

Charles

[11] 4,201,511

[45] May 6, 1980

[54] DEVICE FOR HANDLING CONTAINERS

[75] Inventor: Georges M. Charles, Montceau les Mines, France

[73] Assignee: Potain Poclain Materiel (P.P.M.), Montceau les Mines, France

[21] Appl. No.: 909,046

[22] Filed: May 24, 1978

[30] Foreign Application Priority Data

Jun. 6, 1977 [FR] France ..... 77 17249

[51] Int. Cl.[2] ..... B66F 9/00

[52] U.S. Cl. ..... 414/738; 294/81 SF; 414/690; 414/707

[58] Field of Search ..... 214/147 R, 147 AS, 620, 214/621; 294/67 DA, 81 SF; 414/690, 732, 734, 738, 917, 607, 608, 707

[56] References Cited

U.S. PATENT DOCUMENTS

| | | | |
|---|---|---|---|
| 3,356,238 | 12/1967 | Aldred | 414/732 |
| 3,396,946 | 8/1968 | Maddock | 414/690 X |
| 3,514,002 | 5/1970 | Allegri et al. | 214/621 |
| 3,586,195 | 6/1971 | Beltrami | 414/707 |
| 3,633,777 | 1/1972 | Snelling et al. | 214/621 |
| 3,713,554 | 1/1973 | Thompson et al. | 214/147 AS |
| 3,876,093 | 4/1975 | Carriere | 214/147 R |
| 4,029,230 | 6/1977 | Bolduc et al. | 214/620 X |

FOREIGN PATENT DOCUMENTS 2270191 12/1976 France .

*Primary Examiner*—L. J. Paperner

*Attorney, Agent, or Firm*—Poms, Smith, Lande & Rose

[57] ABSTRACT

An improvement to large container handlers having a transportable platform. A powered positionable support arm is pivotally mounted on one end to the platform for vertical rotation. A L-shaped arm is pivotally mounted from the other end of the support arm to be vertically rotatable. A container gripping device is suspended from the L-shaped arm. In one embodiment, the support arm is mounted to move the L-shaped arm vertically as the support arm is rotated so as to, thereby, raise and lower a container without sidewards movement.

2 Claims, 5 Drawing Figures

1
2
3
4
6
8
9
10
11
14
15
16
17
18
19
20
21
22
23
B

DEVICE FOR HANDLING CONTAINERS

The present invention relates to a device for handling containers.

When they are to be displaced individually from one spot to another, containers are gripped by special gripping apparatus known as "spreaders", the constitution of which is already known. In simplified manner, it is possible to schematise a spreader by describing it as a rectangular or square frame comprising clamps at its four summits.

Handling is often effected in stations specially fitted out with travelling gantry cranes, but it has proved necessary to be able to effect this handling in other places which are not fitted out and by means of mobile self-propelled cranes.

To satisfy this need, the known cranes which are particularly but non-exclusively self-propelled, have had to be completed by a particular handling device which forms the subject matter of the invention.

The invention therefore relates to a device for handling containers comprising a gripping device known as a spreader, mounted at the end of the boom of a handling machine.

SUMMARY

A bracket is pivoted at the end of the boom about a horizontal axis and may be orientated with respect to said boom by means of a hydraulic jack, the substantially horizontal arm of the bracket supporting the spreader by means of at least one deformable tie, such as for example a chain, whilst the other arm, which is substantially vertical, of the bracket may constitute a support for the container.

The following arrangements may also advantageously be adopted:

the substantially vertical arm of the bracket comprises two telescopic sections, the lower section being pivoted on the boom and coupled to the hydraulic jack.

the substantially vertical arm of the bracket is provided with a member for adjusting the position of and for maintaining in position the container with respect to said vertical arm.

said adjusting and holding member is constituted by a pair of clamps mounted to pivot about substantially vertical axes, coupled to jacks for adjusting their pivoting and clasping two opposite side faces of the container.

DESCRIPTION OF THE DRAWINGS

The invention will be more readily understood on reading the following description with reference to the accompanying drawings, in which.

DESCRIPTION OF THE PREFERRED AND OTHER EMBODIMENTS

Figure 1:
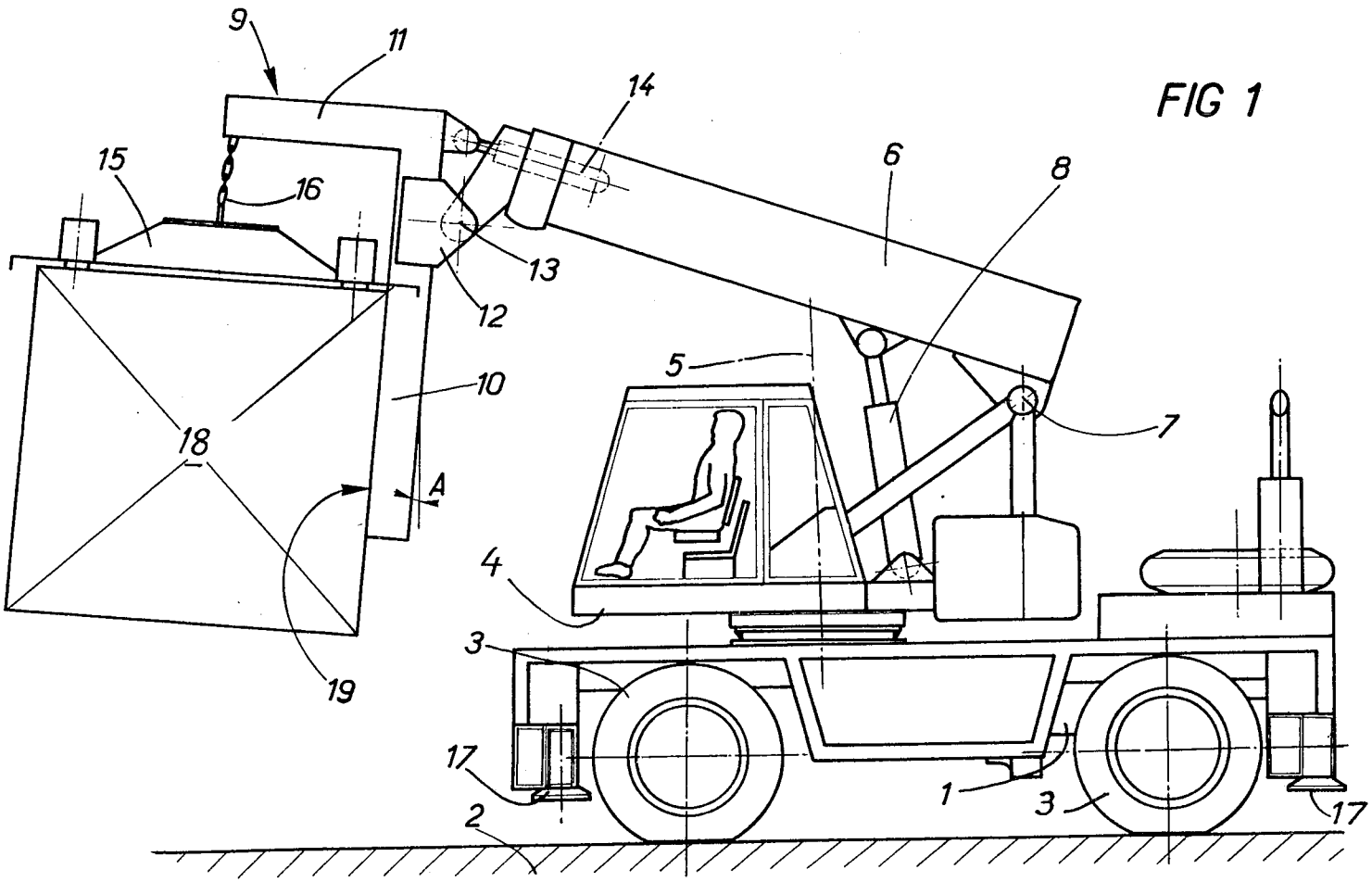
FIG. 1 is a view in elevation of a crane comprising a handling device according to the invention, in the configuration corresponding to the displacement of a container.
Figure 2:
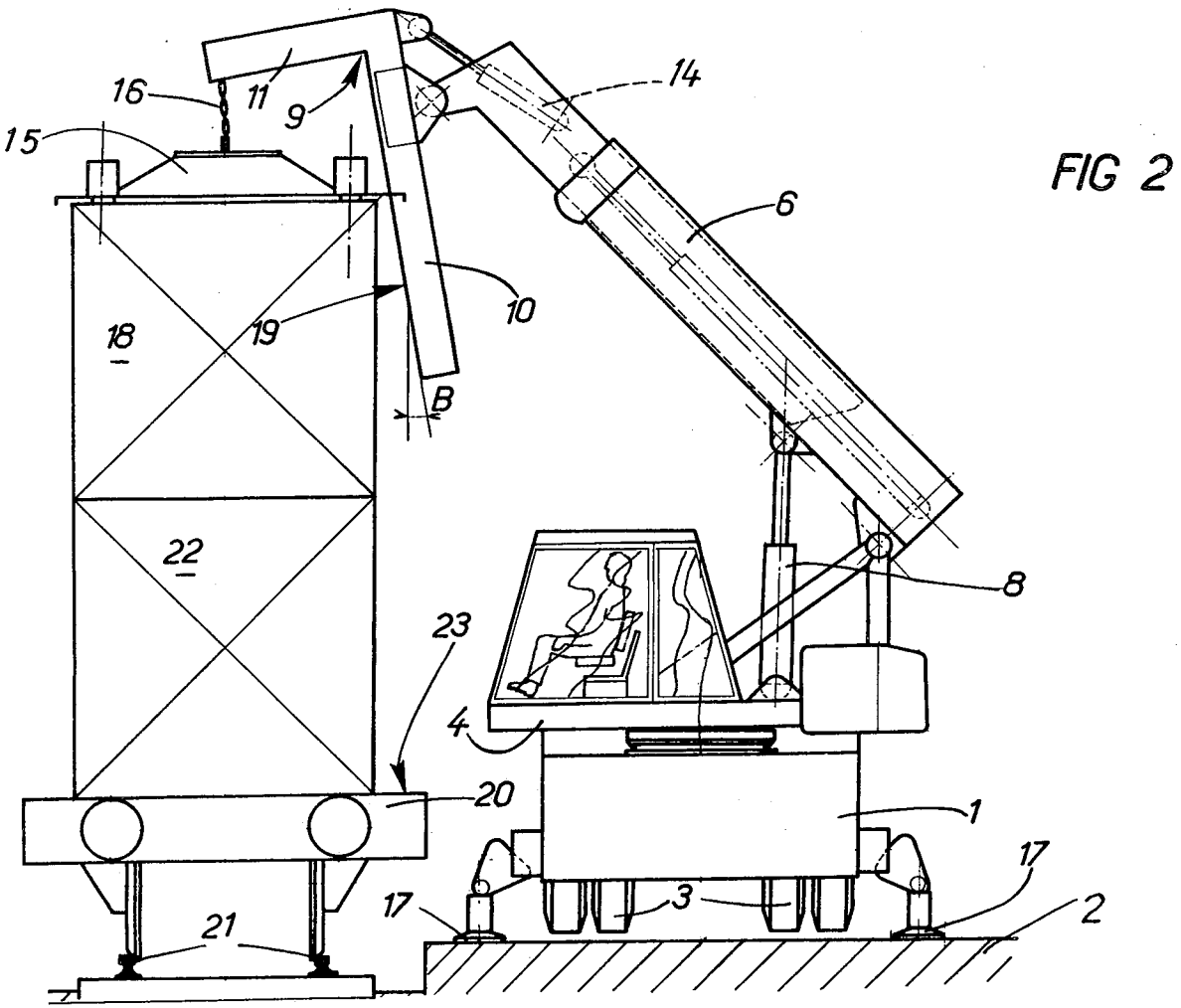
FIG. 2 shows the crane of FIG. 1 in the configuration corresponding to the unloading of the container.

Referring now to the drawings, FIGS. 1 and 2 show the handling machine according to the invention, which is constituted by:

a chassis 1 resting on the ground 2 via its wheels 3;

a turret 4, mounted to pivot on the chassis 1 about a vertical axis;

a telescopic boom 6 which is pivoted on the turret 4 about a horizontal axis 7;

a hydraulic jack 8 for adjusting the orientation of the boom 6, which is coupled between the turret 4 and the boom 6;

an L-shaped bracket 9, of which the two arms 10 and 11 are respectively substantially vertical (10) and horizontal (11), and which, via lugs 12 fast with the substantially vertical arm 10, is pivoted on the end of the last section of the telescopic boom 6 about a horizontal axis 13, another double-acting hydraulic jack 14 which is coupled between said last section of the boom 6 and the bracket 9, a spreader 15 which is suspended from the end of the substantially horizontal arm 11 of the bracket by two chains 16.

Also to be noted is the presence of supports 17 for stabilising the chassis 1 which, not in abutment on the ground, are nevertheless capable to being in abutment thereon.

A container 18 is gripped by the spreader 15 and abuts on the face 19 of the substantially vertical arm 10 of the bracket which in fact is slightly inclined with respect to the vertical (angle A approximately equal to 10°) and the lower end of which advances towards the container 18.

FIG. 2 shows the same machine as FIG. 1, at the moment of depositing the container 18. The machine is in abutment on the ground 2 by means of the stabilisation supports 17, the wheels not touching the ground and is disposed in the vicinity of a railway wagon 20 resting on rails 21. Another container 22 has already been deposited on the platform 23 of the wagon 20.

It will be noted that, by means of the jack 14, the substantially vertical arm 10 of the bracket is maintained slightly inclined with respect to the vertical by an angle B of the order of 10°, but that its lower end is separated from the container 18. This maneuver results in the container 18 no longer abutting on the face 19, whilst remaining, of course, suspended from the substantially horizontal arm 11 of the bracket by chains 16 and the spreader 15.

Figure 3:
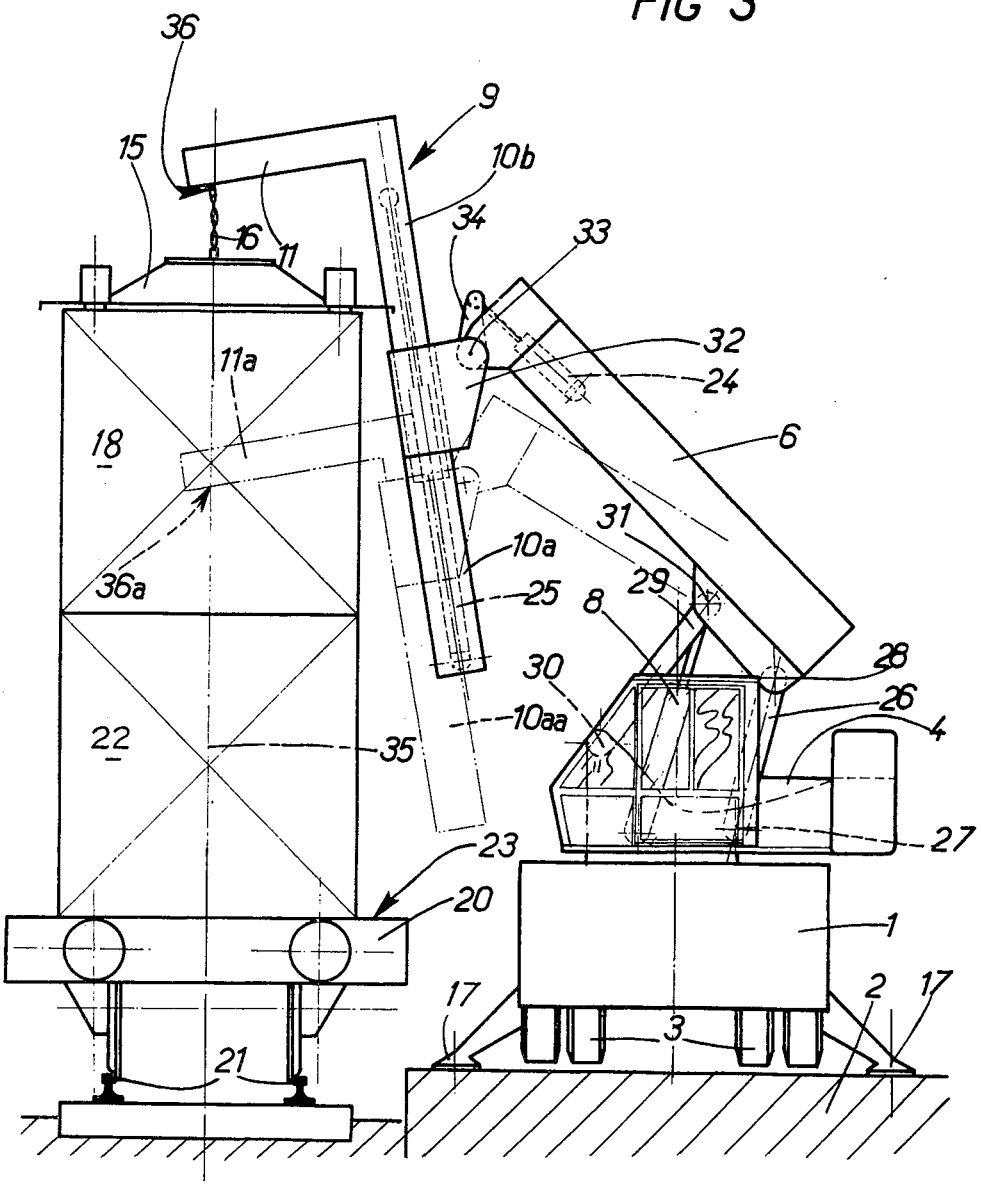
FIG. 3 shows in elevation a variant embodiment of the crane of FIGS. 1 and 2 in the configuration corresponding to the unloading of the container.
Figure 4:
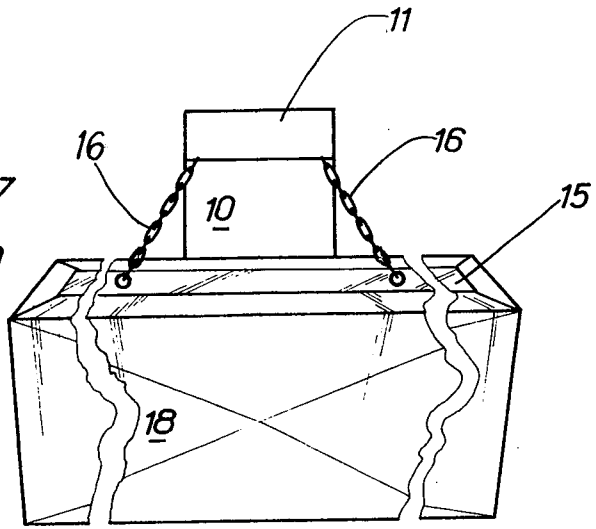
FIG. 4 shows the arrangement of the spreader.

FIG. 3 shows a variant of the machine of FIGS. 1 and 2. Certain of the elements which have already been defined are to be found again, and they are of course provided with the same references. However, the novelty of the following arrangements is to be noted:

The boom 6 is no longer pivoted about axis 7 but is connected to the turret 4 by two connecting rods 26, 29, which are pivoted respectively about axes 27, 30 on the turret 4 and 28, 31 on boom 6. The jack 8 remains coupled between the boom 6 and the turret 4;

The bracket 9 is further constituted by a substantially horizontal arm 11 and by a substantially vertical arm, but this latter is telescopic and comprises two sections 10*a* and 10*b*, a jack 25 being coupled between these sections to adjust the relative position thereof.

The arms 11 and 10b are fast with each other, whilst lugs 32, fast with the lower section 10a, are pivoted on the end section of the boom 6 about an axis 33. A jack 24 is coupled between the end section of the boom 6 and a lever 34, fixed with respect to the lugs 32.

It will further be noted that the chains 16 as well as their point of suspension 36 from the arm 11 are contained in a vertical plane 35, and that, due to the adjustment of the relative position of the sections 10a, 10b of the substantially vertical arm of the bracket and to the adjustment of the position of the boom 6, this point of suspension of the chains remains contained in the plane 35, when the container 22 is handled. The substantially horizontal arm of the bracket is then disposed at 11a, and the point of suspension at 36a, the substantially vertical arm of the bracket itself being located at 10aa. These elements are shown in broken lines.

Figure 5:
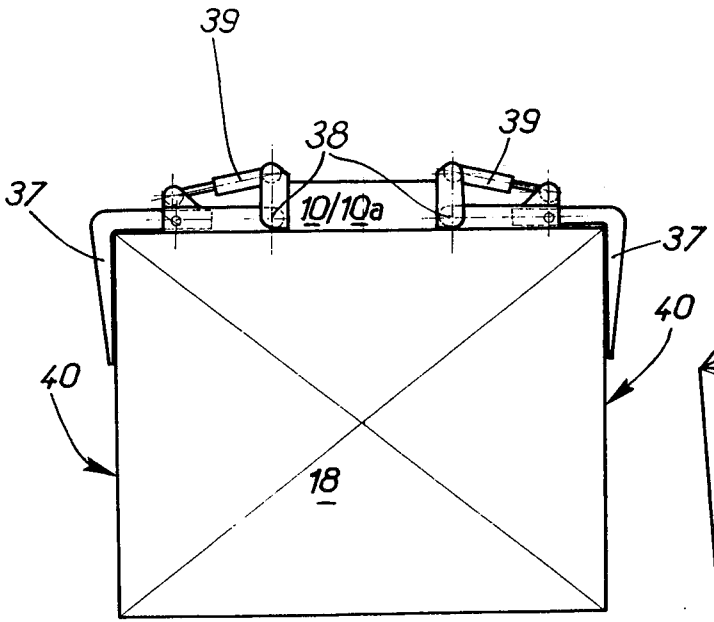
FIG. 5 shows in plan view a complementary device for stabilising the containers.

Finally, with regard to FIG. 5, it will be noted that the arms 37 of a clamp may be pivoted, on the arm 10 or the section 10a, about axes 38 parallel to said arm or section, therefore substantially vertical. A jack 39 is coupled between each clamp arm 37 and the arm 10 or section 10a, and allows the container 18 to be maintained in position, by the arms 37 which are in abutment on the opposite vertical faces 40 of the container 18.

The machines which have been described are simple and efficient and enable a container 18 to be conveyed from one spot to another by being held satisfactorily by its abutment on the face 19 of the substantially vertical arm of the bracket 9.

When the machine is equipped with stabilization clamps (37), the holding of the container is possibly even completed by abutment of the arms 37 of the clamp on the vertical side faces 40.

On this point, it will readily be appreciated that it is generally advantageous to provide the handling device which has been described, with a member for adjusting the position of the container and for maintaining this container in position with respect to the vertical arm 10 or 10a. This member, which is advantageously constituted by the clamps 37, may also be constituted, more simply, by centering ramps fixed on the arm, for example by welding.

The advantage of the variant with telescopic arm 10a, 10b has further been noted, it residing in the ease of maneuvering, mainly when depositing and taking up a container.

What is claimed is:

1. In apparatus for handling large containers wherein the apparatus has a platform mounted on a transporting device, the improvement comprising:

(a) a support arm pivotally carried by the platform adjacent one end of said support arm for rotation in a vertical plane;

(b) first power means operably connected between said support arm and the platform for selectively rotating said support arm;

(c) an L-shaped arm having a generally horizontal member and a generally downward-facing vertical member, said L-shaped arm being pivotally carried by the other end of said support arm for rotation in a vertical plane, said generally downward-facing vertical member of said L-shaped arm being a telescoping arm and including second power means for selectively extending and retracting said generally downward-facing vertical member, said L-shaped arm being pivotally carried by said support arm at a point on said generally downward-facing vertical member such that said generally horizontal member of said L-shaped arm is raised and lowered as said generally downward-facing vertical member is extended and retracted respectively;

(d) third power means operably connected between said L-shaped arm and said support arm for selectively rotating said L-shaped arm; and, (e) gripping means suspended from said generally horizontal member of said L-shaped arm for releasably gripping the top of large containers whereby large containers can be gripped by said gripping means and be selectively supported simultaneously along the side thereof by rotating said L-shaped arm to place said generally downward-facing vertical member into or out of engagement with the side of the container.

2. In apparatus for handling large containers wherein the apparatus has a platform mounted on a transporting device, the improvement comprising:

(a) a support arm pivotally carried by the platform adjacent one end of said support arm for rotation in a vertical plane;

(b) first power means operably connected between said support arm and the platform for selectively rotating said support arm;

(c) an L-shaped arm having a generally horizontal member and a generally downward-facing vertical member, said L-shaped arm being pivotally carried by the other end of said support arm for rotation in a vertical plane;

(d) second power means operably connected between said L-shaped arm and said support arm for selectively rotating said L-shaped arm;

(e) gripping means suspended from said generally horizontal member of said L-shaped arm for releasably gripping the top of large containers whereby large containers can be gripped by said gripping means and be selectively supported simultaneously along the side thereof by rotating said L-shaped arm to place said generally downward-facing vertical member into or out of engagement with the side of the container;

(f) a pair of opposed spaced gripping arms carried by said generally downward-facing vertical member; and, (g) third power means operably connected between said gripping arms and said generally downward-facing vertical member for selectively moving said gripping arms towards and apart from one another whereby said gripping arms can selectively grip opposite sides of the container suspended by said gripping means.

* * * * *